United States Patent [19]

Norris

[11] 4,392,188

[45] Jul. 5, 1983

[54] TROUBLE LIGHT ASSEMBLY POSITIONER

[76] Inventor: Kenneth E. Norris, 61352 Tombstone Dr., Montrose, Colo. 81401

[21] Appl. No.: 354,604

[22] Filed: Mar. 4, 1982

[51] Int. Cl.[3] ..... F21V 21/26

[52] U.S. Cl. ..... 362/269; 362/285; 362/376; 362/389; 362/396; 362/398; 362/418; 362/427

[58] Field of Search ..... 362/269, 285, 376, 389, 362/396, 398, 418, 427

[56] References Cited

U.S. PATENT DOCUMENTS

| | | | |
|---|---|---|---|
| 2,460,173 | 1/1949 | Halbing | 362/376 |
| 2,520,503 | 8/1950 | Henning | 362/389 X |
| 3,244,873 | 4/1966 | Leutheuser | 362/376 |
| 4,220,304 | 9/1980 | Wong et al. | 362/398 |
| 4,298,922 | 11/1981 | Hardwick | 362/396 X |

*Primary Examiner*—Stephen J. Lechert, Jr.

[57] ABSTRACT

A device for allowing a trouble light to provide a desired lighting effect by being resistably rotated to any position about its longitudinal axis while lying on a flat surface or affixed to a ferrous surface by a magnet, which comprises a resistably rotating means and a support member, where the trouble light and resistably rotating means rotate relative to the support member with the support member restrained from rotating by communication between a flat surface on the periphery of the support member and a foreign surface.

13 Claims, 4 Drawing Figures

TROUBLE LIGHT ASSEMBLY POSITIONER

BACKGROUND OF THE INVENTION

1. Field of the Invention

The invention relates generally to a device for positioning a trouble light assembly rotationally about its longitudinal axis while lying on a flat surface or while affixed to a ferrous surface by an integral magnet to achieve a desired lighting effect.

2. Description of the Prior Art

Trouble lights currently in use, utilize a hook mounted on the reflector-guard to hang and position the trouble light for a desired lighting effect. Many times no object exists in the proper location to which the hook may be affixed to properly position the trouble light. Also, when working underneath a machine, such as an automobile, on a flat surface the trouble light will tend to easily rotate and not provide light where it is needed. This invention eliminates this problem.

SUMMARY OF THE INVENTION

The invention relates to a device to allow a trouble light to be positioned at any rotational position about its longitudinal axis while on a flat surface or affixed to a ferrous surface by a magnet. It comprises a means for attaching the invention to the trouble light assembly, a resistably rotating means and a support member.

It is an object of the invention to provide an inexpensive device which will allow more efficient use of a trouble light, which will increase worker productivity.

DESCRIPTION OF THE PREFERRED EMBODIMENT

Figure 1:
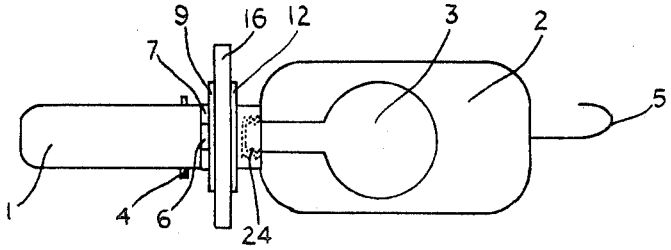
FIG. 1 is a plan view showing an embodiment of the Trouble Light Assembly Positioner.
Figure 2:
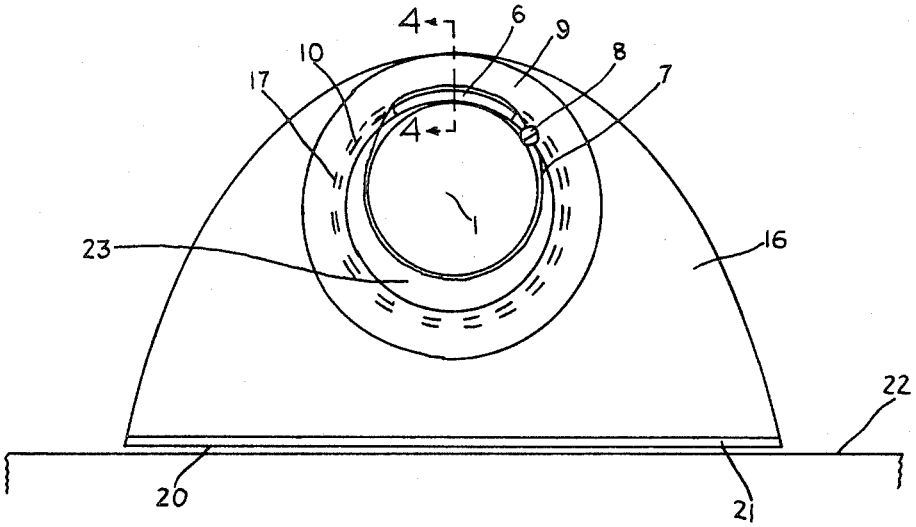
FIG. 2 is an elevation view of the embodiment of the Trouble Light Assembly Positioner.
Figure 3:
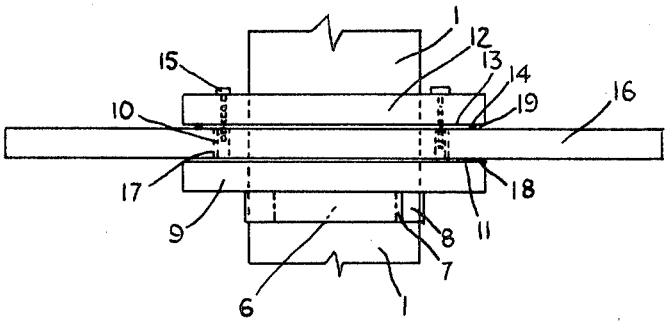
FIG. 3 is a plan view showing in greater detail, the embodiment of the Trouble Light Assembly Positioner.
Figure 4:
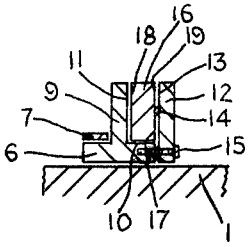
FIG. 4 is a sectional view, along Section 4—4 of FIG. 2.

Referring to FIGS. 1, 2, 3, and 4, an embodiment of the invention is shown in which the Trouble Light Assembly Positioner is attached to the handle 1 of a trouble light assembly. The trouble light assembly is comprised of a handle 1 and a reflector-guard 2. Other parts of the trouble light include a hook 5, a light switch 4 and a light bulb 3 which is affixed to the handle 1 by the bulb base 24. The light bulb 3 and handle 1 comprise the handle-bulb assembly.

In this embodiment, a fastening means which is shown as a clamp fastener 7 and an attachment lip 6 integral with the resistably rotating means, fastens the resistably rotating means to the handle 1. The resistably rotating means is shown in this embodiment as having the major elements of a support member housing 9 and a frictional adjustment plate 12.

The internal opening 23 of the housing 9 is large enough to fit over the handle 1 and light switch 4, to allow positioning in a location near the reflector-guard 2. When in the desired position the clamp fastener 7 is tightened, which draws the handle 1 against the lip 6 for a secure attachment. The embodiment shown can be marketed separately from the drop cord light assembly.

Integral with the lip 6 is the support member housing 9, which at am outer circumferential bearing surface 10 and housing side bearing surface 11 rotatingly communicates with the inner circumferential bearing surface 17 and first side bearing surface 18 of the support member 16. A frictional adjustment plate 12 is fastened by mounting screws 15 to the support member housing 9 and provides a plate side bearing surface 13 to rotatingly communicate with the second side bearing surface 19 of the support member 16. A friction spring 14 may be mounted circumferentially between the support member housing side bearing surface 11 and the support member first side bearing surface 18, or between the frictional adjustment plate side bearing surface 13 and the support member second side bearing surface 19, to provide a more effective constant rotational resistive force between the side bearing surfaces such that the resistably rotating means tends to hold at any rotational position. The support member 16, in this embodiment, is shown as a disc which rotatingly communicates with the support member housing 9 and the frictional adjustment plate 12. The support member 16 has a flat bearing surface 20 on its periphery which communicates with a foreign surface 22 to prevent rotation of the support member 16 with respect to the foreign surface 22. In many cases the foreign surface 22 is a garage or shop floor or a ferrous surface. The flat bearing surface 20 may contain a magnet 21 so that the support member 16 can be affixed to any ferrous surface to provide many more lighting positions.

Although one detailed embodiment of the invention is illustrated in the drawings and previously described in detail, this invention contemplates any configuration and design of components which will accomplish the equivalent result. As an example, the invention can be manufactured as an integral part of the handle 1. As another example, the invention can be manufactured and marketed as a separate unit, which can be attached to the reflector-guard 2. As a further example, the invention can be manufactured as an integral part of the reflector-guard 2.

I claim:

1. A trouble light assembly positioner which comprises:

(a) means for resistably rotating the trouble light assembly about an axis parallel to its longitudinal axis;

(b) means for attaching the resistably rotating means to the trouble light assembly such that they rotate as an integral unit; and (c) a support member which rotatingly engages the resistably rotating means, with the support member horizontal rotational axis, the trouble light assembly horizontal longitudinal rotational axis and the resistably rotating means horizontal rotational axis all parallel, with at least part of the weight of the trouble light assembly transmitted through the resistably rotating means to the support member, with the support member having at least one flat bearing surface on its periphery which communicates with a foreign surface to prevent rotation of the support member, so that the trouble light assembly may be rotated relative to the support member to any position about the horizontal rotational axis of the resistably rotating means, which allows the desired lighting effect.

2. A trouble light assembly positioner as recited in claim 1, in which:

(a) the resistably rotating means has an internal opening therethrough of greater diameter than the handle, through which the handle is positioned; and (b) the support member has an inner circumferential bearing surface which concentrically rotates about a resistably rotating means outer circumferential bearing surface, and the support member and the resistably rotating means share a common horizontal rotational axis.

3. A trouble light assembly positioner as recited in claim 2, in which the attaching means comprises a clamp fastener which extends around the circumference of the handle and fastens the handle to the resistably rotating means.

4. A trouble light assembly positioner as recited in claim 3, in which the support member is the shape of a disc.

5. A trouble light assembly positioner as recited in claim 4, in which the resistably rotating means comprises:

(a) a support member housing to rotatingly communicate with, support and guide the support member at its inner circumferential bearing surface and first side bearing surface; and (b) a frictional adjustment plate to rotatingly communicate with, support and guide the support member second side bearing surface, with the plate adjustable as to pressure exerted on the second side bearing surface of the support member so that the rotational frictional resistance may be adjusted.

6. A trouble light assembly positioner as recited in claim 5, in which the attaching means comprises:

(a) a lip, integral with the support member housing, which protrudes horizontally outward from the edge of the internal opening of the support member housing; and (b) a clamp fastener with a tightening means, which extends around the outside surface of the lip and the circumference of the handle, which fastens the handle to the support member housing.

7. A trouble light assembly positioner as recited in claim 1, in which the support member flat bearing surface comprises a magnet so that the support member may be magnetically attached to any ferrous surface.

8. An improved trouble light assembly of the type in which the assembly contains a handle, and a reflector-guard, wherein the improvement comprises:

(a) a means, integral with the trouble light assembly, for resistably rotating the trouble light assembly about an axis parallel to its longitudinal axis; and (b) a support member which rotatingly engages the resistably rotating means, with the support member horizontal rotational axis, the trouble light assembly horizontal longitudinal rotational axis and the resistably rotating means horizontal rotational axis all parallel, with at least part of the weight of the trouble light assembly transmitted through the resistably rotating means to the support member, with the support member having at least one flat bearing surface on its periphery which communicates with a foreign surface to prevent rotation of the support member, so that the trouble light assembly may be rotated relative to the support member to any position about the horizontal rotational axis of the resistable rotating means, which allows the desired lighting effect.

9. An improved trouble light assembly as recited in claim 8, in which:

(a) the resistably rotating means has an internal opening therethrough of greater diameter than the handle, through which the handle is positioned; and (b) the support member has an inner circumferential bearing surface which concentrically rotates about a resistably rotating means outer circumferential bearing surface, and the support member and the resistably rotating means share a common horizontal rotational axis.

10. An improved trouble light assembly as recited in claim 9, in which the support member is the shape of a disc.

11. An improved trouble light assembly as recited in claim 10, in which the resistably rotating means comprises:

(a) a support member housing to rotatingly communicate with, support and guide the support member at its inner circumferential bearing surface and first side bearing surface; and (b) a frictional adjustment plate to rotatingly communicate with, support and guide the support member second side bearing surface, with the plate adjustable as to pressure exerted on the second side bearing surface of the support member so that the rotational frictional resistance may be adjusted.

12. An improved trouble light assembly as recited in claim 8, in which:

(a) the resistably rotating means has an internal opening therethrough of greater diameter than the bulb base and is fastened circumferentially to the reflector-guard; and (b) the support member has an inner circumferential bearing surface which concentrically rotates about a resistably rotating means outer circumferential bearing surface, and the support member and the resistably rotating means share a common horizontal rotational axis.

13. An improved trouble light assembly as recited in claim 8, in which the support member flat bearing surface comprises a magnet so that the support member may be magnetically attached to any ferrous surface.

* * * * *